United States Patent [19]

Mattsson

[11] Patent Number: 4,477,929

[45] Date of Patent: Oct. 23, 1984

[54] PROTECTIVE HELMET

[75] Inventor: Stig Mattsson, Karlsholmsbruk, Sweden

[73] Assignee: Frosta Fritid AB, Gavle, Sweden

[21] Appl. No.: 545,708

[22] Filed: Oct. 26, 1983

[30] Foreign Application Priority Data

Nov. 1, 1982 [SE] Sweden ..... 8206205

[51] Int. Cl.[3] ..... A63B 1/08

[52] U.S. Cl. ..... 2/425; 2/417; 2/418; 2/423

[58] Field of Search ..... 2/425, 417, 418, 419, 2/420, 421, 422, 423, 424

[56] References Cited

U.S. PATENT DOCUMENTS

| | | | |
|---|---|---|---|
| 3,105,240 | 3/1963 | Jansson | 2/420 |
| 3,107,356 | 8/1963 | Pestronik et al. | 2/420 |
| 3,629,864 | 12/1971 | Latina | 2/420 |
| 4,279,038 | 7/1981 | Brückner et al. | 2/417 |
| 4,404,690 | 9/1983 | Farquharson | 2/420 |

*Primary Examiner*—Werner H. Schroeder
*Assistant Examiner*—Mary A. Ellis
*Attorney, Agent, or Firm*—Sughrue, Mion, Zinn, Macpeak, and Seas

[57] ABSTRACT

An ice-hockey helmet includes a front part and a back part which are hinged together and which, to enable the size of the helmet to be altered, are arranged to be swung to and locked in different positions relative to one another. The front part forms the major part of the helmet and is provided with ear guards having chin strap attaching means, while the back part has the form of a basin-shaped neck guard. The neck guard can be swung as a flap, relative to the front part of the helmet, about a substantially horizontal hinge means. To enable the helmet to be altered precisely to selected sizes, the front and back parts of the helmet are provided with mutually co-acting portions which when the back part of the helmet is swung relative to the front part thereof, so as to shorten the helmet, cause the helmet to be drawn together, so as to reduce the width thereof.

8 Claims, 7 Drawing Figures

PROTECTIVE HELMET

Figure 1:
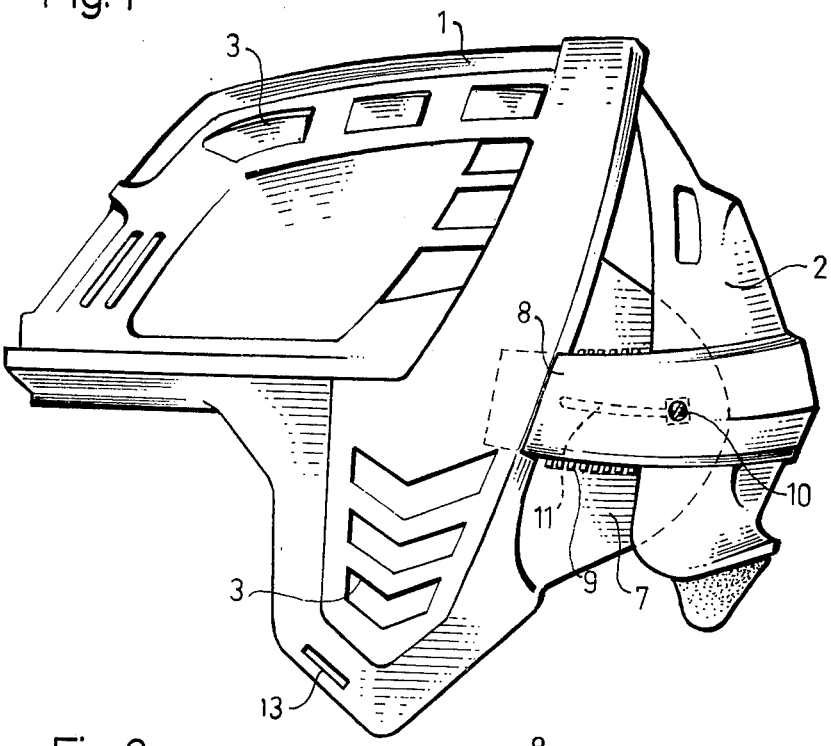

The present invention relates to a protective helmet, and more particularly to a protective helmet for ice-hockey players or bandy players, the helmet comprising mutually connected pivotable front and back parts which are arranged to be swung to different positions relative to one another and to be locked in said positions, so as to alter the size of said helmet.

In order for an ice-hockey helmet to afford satisfactory head protection, it must be capable of withstanding heavy blows without deforming, for example such blows as those which might be experienced from a flying puck, a fall against the ice or against the rink sideboards, or from a club. It must also be able to absorb satisfactorily the force of an impact. In addition hereto, it must be light in weight. Naturally, such a helmet must not exhibit openings through which a puck or the sharp end of a club can penetrate, but shall have a purposeful design which ensures that all parts of the head are covered. The helmet shall also be designed in a manner which permits a grid-like vizor or plexiglass guard to be affixed thereto in a stable and reliable fashion.

One basic requirement of an ice-hockey helmet which is often passed-over or ignored, but which is, nevertheless, quite decisive in ensuring that a helmet fulfilling the aforesaid demands affords the protection for which it is meant, is that it properly fits the head of the wearer, so that the helmet is always seated correctly in the manner intended.

In order to allow a helmet of the kind described to be made larger or smaller, the helmets are normally made in several pieces, which are riveted or screwed together, to produce a helmet of the desired size. Among other things, this means that mutually different helmet sections must overlap each other, to a greater or lesser extent, resulting in additional consumption of material and an increase in weight.

In one known embodiment of an ice-hockey helmet, the helmet is produced as a single piece structure, having the form of two pivotably connected parts which can be locked in different positions relative to one another. In this known embodiment, the main part of the helmet consists of the neck-protecting part and the side parts with ear guards, said main part being held in place by a chin strap. In this main part of the helmet there is provided a front section which is intended to protect the crown of the head and the forehead and to carry a vizor or the like, and which is pivotably connected through a substantially horizontal pivot means, so as to enable said front part to be raised and lowered in the form of a flap. This flap can be secured to the back part of the helmet in different positions, to change the length of the helmet. It is not possible, on the other hand, to change the width of the helmet, which means that the helmet cannot be altered with sufficient accuracy to fit heads of differing sizes, with the snugness required.

A main object of the present invention is to provide a helmet of the kind described in the introduction, which in addition to fulfilling all the usual requirements placed on a helmet of this nature, can also be altered to fit individual head sizes, so as to fit snugly and correctly at all times and therewith provide better protection.

Accordingly, there is provided in accordance with the invention a helmet of the aforementioned kind in which the front part forms the major part of the helmet and is provided with ear guards and a chin strap, while the back part has the form of a basin-shaped neck guard which can be swung in the manner of a flap relative to the front part, about a substantially horizontal hinge means; and that the front and back parts of the helmet are provided with co-acting portions which when the back part is swung towards the front part, to shorten the helmet, also cause the width of the helmet to be correspondingly reduced.

Preferably, the front part of the helmet is provided with rearwardly and outwardly projecting portions which, when making the helmet smaller, are arranged to co-act with the rear part of the helmet, in a manner to reduce the width of said front part. In this respect, the rearwardly and outwardly projecting portions are conveniently connected to the earguard sections of the helmet, said sections, inter alia, being pressed closer together when the helmet is made smaller.

In a preferred embodiment of the invention, said back part is provided with forwardly and outwardly projecting tongues which extend outside the rearwardly projecting sections and are guided in said front part. Conveniently, said tongues and/or rearwardly projected sections are provided with friction enhancing means which permit the front and back parts of the helmet to be locked together in said relative manner, by pressing said tongues and sections together with the aid of some suitable means.

The helmet is suitably provided with a comfort lining in the form of soft foam-rubber pads, to enable the helmet fitting to be finely adjusted.

The impact-receiving shell of the helmet is suitably in the form of a laminate structure, comprising a thin outer plastics layer having bonded to the inner surface thereof a layer of reinforcing and impact-absorbing plastics, suitably a layer of polyurethane. The helmet is suitably formed in one piece, with the hinge means between the front and back parts of the helmet being formed in the outer plastics layer.

Figure 2:
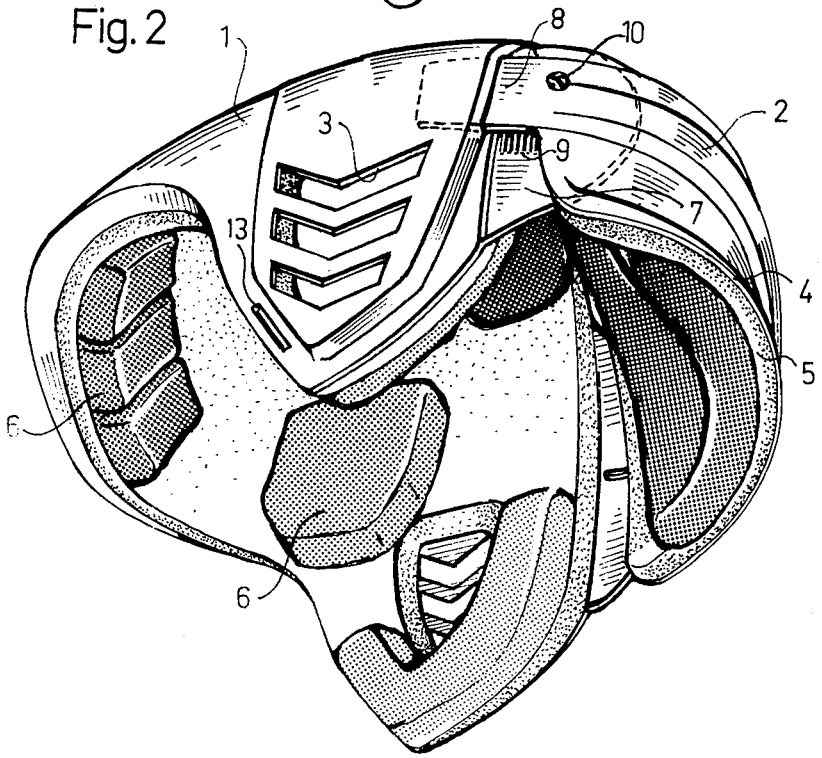

The invention will now be described in more detail with reference to the accompanying drawings, in which FIGS. 1 and 2 illustrate respectively a helmet according to the invention in side view and as seen obliquely from beneath.

Figure 3:
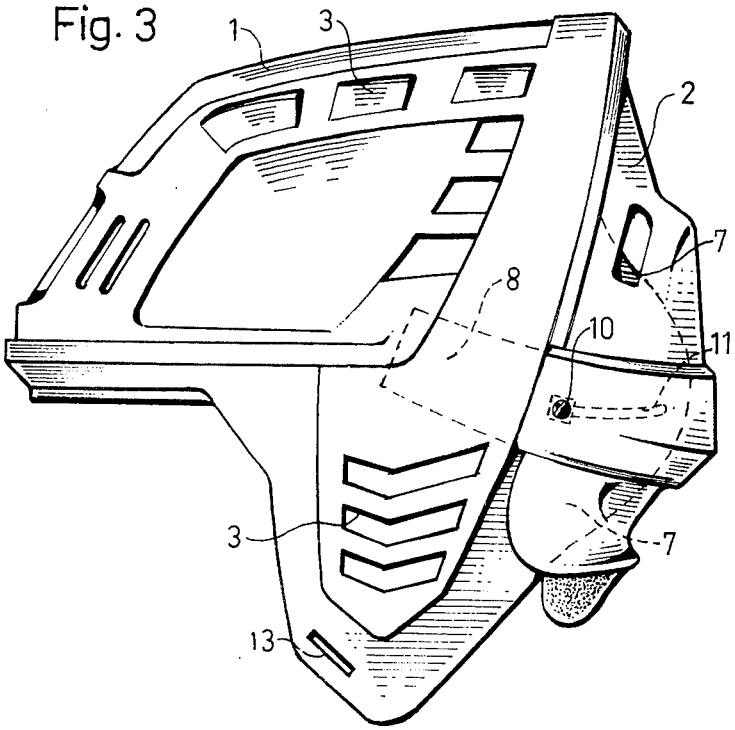
Figure 4:
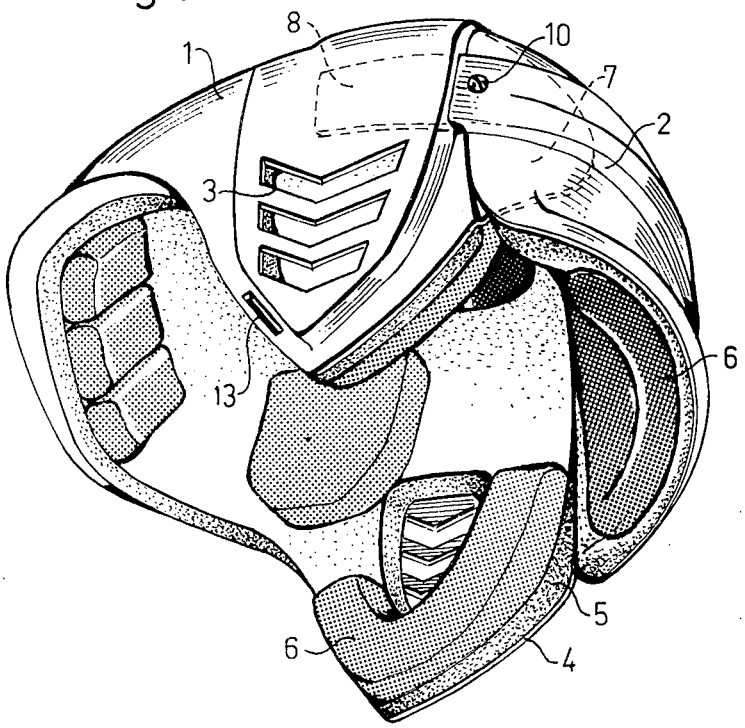
Figure 5:
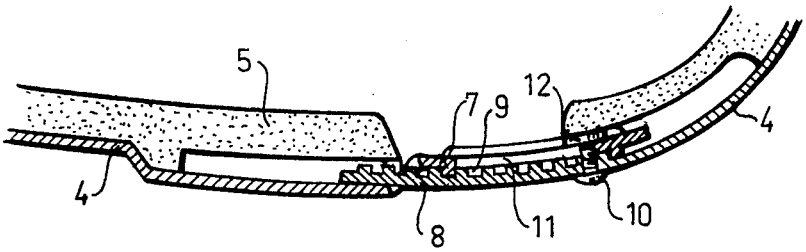
Figure 6:
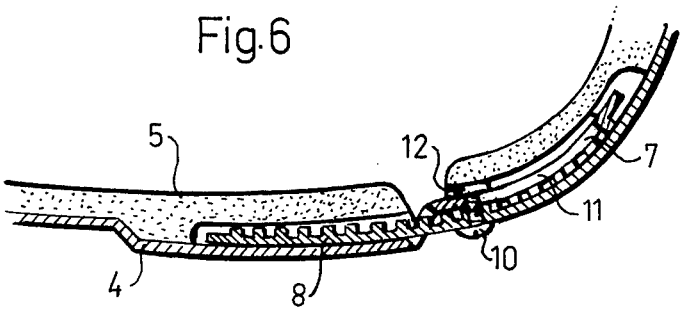

FIGS. 3 and 4 are views which correspond to the views of FIGS. 1 and 2 and which show the helmet locked in its fully collapsed state; and FIGS. 5 and 6 are schematic, part-sectional views illustrating the size setting of the helmet, FIG. 5 corresponding to the helmet shown in FIGS. 1 and 2 and FIG. 6 corresponding to the helmet shown in FIGS. 3 and 4.

Figure 7:
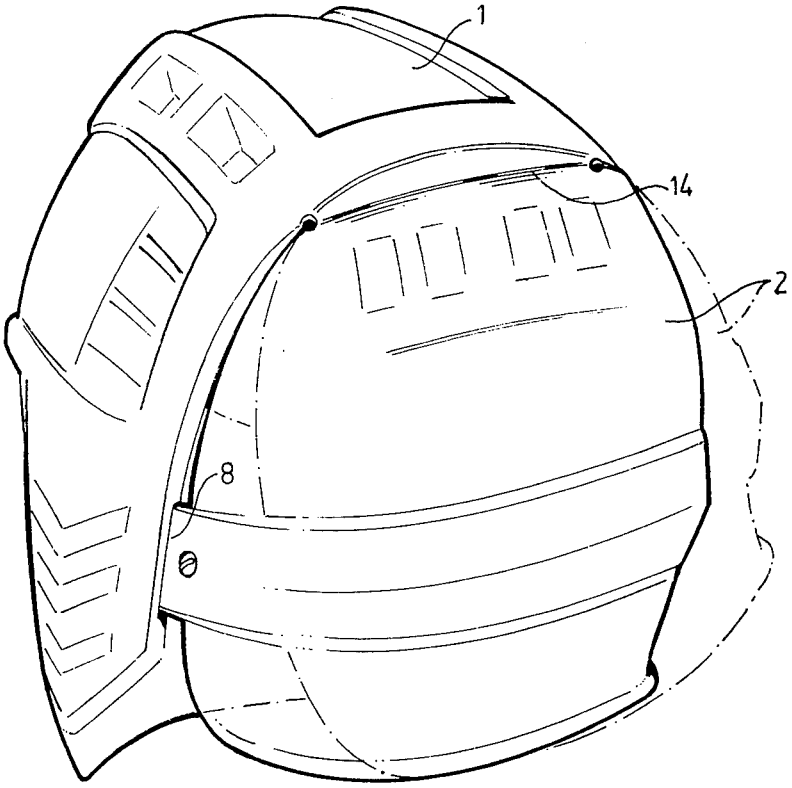

FIG. 7 is a rear view of the helmet as seen obliquely from one side.

As will be seen from FIGS. 1 and 2, a helmet according to the invention includes two parts, a forward, head-fitting part 1 and a back, flap-like neck-protecting part 2, which is pivotably connected to the front part 1 by horizontal hinge means 14 illustrated in FIG. 7. The hinge means 14 has the form of a weakening in the outer plastics layer of the helmet. The front of the helmet slopes sharply, to deflect pucks and blows. It is also provided with a number of perforations 3, to permit an effective change of air to take place in the interior of the helmet.

As can be seen, among other things, from FIG. 2, the helmet comprises a relatively thin, impact-receiving plastics layer 4, which has firmly bonded to the inner surface thereof a reinforcing and impact-absorbing plastics layer 5. The layer 5 is suitably formed by applying a layer of polyurethane to said outer layer 4. Because the layer 5 is permanently bonded to the layer 4, there is obtained a laminate structure which is highly impact resistant and which effectively absorbs the impact forces. The polyurethane layer 5 has the dual function of reinforcing the helmet and of absorbing the impact forces to which it is subjected, and hence the helmet is light in weight, because its thickness is thereby reduced. The thickness of the layer 5 varies throughout the helmet, in response to mechanical strength and impact-absorption requirements. The layer 5 of the illustrated embodiment is provided with a comfort lining, which comprises a plurality of extremely soft foam-plastic pads, which are compressed to a greater or lesser extent when the helmet is worn. Thus, these pads automatically finely adjust the size and shape of the helmet to the main shape and form of the head of the wearer. The comfort lining projects beyond the confines of the shell of the helmet at certain locations, for example in the location of the neck of the wearer.

As will be seen from FIG. 1, it is the front part 1 which is the larger of the two helmet parts, and thus forms the major part of the helmet. It is this part which is provided with ear-guarding, downwardly extending sections to which a chin strap can be coupled via slots 13, for reliably securing the helmet to the head of the wearer. Any vizors or plexiglass guards provided are fitted to that part of the helmet which is firmly held on the head of the wearer. Among other things, this is important in preventing the helmet from twisting and sliding down as a result of the weight of the vizor and, in preventing that part of the helmet carrying the vizor from being raised or the helmet being twisted rearwardly on the head of the wearer, should the vizor be subjected to an upwardly directed force, e.g. an impact force.

For the purpose of altering the size of the helmet, the front part thereof is provided with rearwardly projecting sections 7 which are arranged to co-act with the converging inner surface of the back part 2 of the helmet. The back part 2 is provided with forwardly projecting tongues 8, which extend outside the sections 7 and are guided in grooves or slots in the front part 1 of said helmet. The sections 7 and/or the tongues 8 may be provided with teeth or serrations 9, to permit positive locking of the parts 1 and 2 of the helmet in the selected relative positions, by pressing mutually adjacent parts of sections 7 and tongues 8 together with the aid of a screw 10 or like device. In the illustrated embodiment, the tongues 8 are provided with holes for the screws 10, while the sections 7 are provided with elongate slots 11 for enabling the back part, or flap, 2 of the helmet to be swung relative to the front part 1 thereof.

When the flap 2 is swung towards the front part 1 of the helmet, the front-to-rear length of helmet is shortened. Due to the converging inner surface of the flap or back part 2, however, the front portions of the sections 7 will be successively pressed together, which results in those side parts of the helmet which include the ear-guard sections thereof also being drawn together, thereby also to decrease the width of the helmet. In this way, the helmet can be made to sit very firmly on the head of the wearer, without squeezing or pinching the head.

In FIGS. 1 and 2, the helmet is shown in its fully extended, locked position, i.e. with the screw 10 at the far end of the slot 11. FIGS. 3 and 4 show a corresponding helmet which has been adjusted to its smallest size, or fully collapsed state, with the screw 10 at the other end of the slot 11. In this respect the sections 7 co-act with the basin-shaped neck part 2 along the whole of their lengths, and the screw 10 is located at the near end of the slot 11. As will be understood, the helmet can also be adjusted to any size between these two extremities.

The manner in which the sections 7 and the tongues 8 co-act with one another when altering the size of the helmet is illustrated by the part-sectional views in FIGS. 5 and 6. FIG. 5 illustrates the positions between one section 7 and a corresponding tongue 8, when the helmet is fully extended in accordance with FIGS. 1 and 2. As will be seen, the section 7 and the tongue 8 are provided with intermeshing teeth 9, which are held in engagement with one another by means of the screw 10. The screw co-acts with a nut 12, which is non-rotatably displaceable in a slot arranged in the section 7. As can be seen, both the section 7 and the tongue 8 project into cavities between the outer plastics layer 4 of the helmet and the reinforcing, impact-absorbing layer 5 thereof.

FIG. 6 is a corresponding sectional view, in which the helmet is adjusted to its smallest size, in accordance with FIGS. 3 and 4. Consequently, the screw 10 and the nut 12 have been moved to the other end of the slot 11. In this case, the section 7 co-acts with the inner surface of the flap-like back part 2 of the helmet, so as to also draw in the helmet laterally.

As shown in the aforegoing, a helmet according to the invention can be made as a one piece structure, in which the size of the helmet can be altered with the aid of just two screws. This greatly simplifies both manufacture, assembly and the use of the helmet.

Although the invention has been described and illustrated with reference to a particular embodiment thereof, various modifications can be made within the scope of the claims. For example, the general form of the helmet can be varied as desired, and the two parts of the helmet can be locked together in any suitable manner. Although not shown, the helmet is intended to be provided with a grid-type vizor or plexiglass guard, which shall be attached to that part of the helmet which is gripped to the head of the wearer. Those members which are effective in adjusting the width of the helmet can also be modified in any suitable manner. For example, the front part of the helmet can be drawn in with the aid of sections projecting from the back part of the helmet. It is only essential that the front and back parts of the helmet are provided with co-acting parts which provide the required contracting effect in shortening the helmet. The comfort lining in the form of soft pads 6 can also be of any desired form, and may comprise a single, replaceable coherent unit.

What is claimed is:

1. A one-piece protective helmet, particularly a helmet for ice-hockey and bandy players, which includes pivotally connected front and back integral parts which are arranged to be swung to different positions relative to one another and to be locked in said positions, so as to alter the size of said helmet, wherein the front part of the helmet forms the major part thereof and is provided with ear guards and means for attaching a chin strap, while the back part forms the minor part of the helmet and has the form of a basin-shaped neck guard which can be swung as a flap relative to the front part, about a substantially horizontal integral hinge means at the top of said neck guard; and the front and back parts are provided with mutually co-acting portions which, when the back part of the helmet is swung towards the front part thereof to shorten the distance between said parts and, thus, to shorten the length of said helmet, also cause the width of the helmet to be altered to a corresponding extent.

2. A helmet according to claim 1, wherein the front part of said helmet is provided with rearwardly projecting sections which, when reducing the size of the helmet, are arranged to co-act with curved surfaces on the back part to decrease the lateral distance between said sections and, thus, the width of said front part.

3. A helmet according to claim 2, wherein said sections are joined to the ear guards of the helmet; and, inter alia, said ear guards are arranged to be pressed laterally closer to each other when the helmet is made smaller.

4. A helmet according to claim 2, wherein the back part of the helmet is provided with forwardly projecting tongues which extend outside said rearwardly projecting sections and are guided in the front part of said helmet.

5. A helmet according to claim 4, wherein said tongues and/or said rearwardly projecting sections is, or are, provided with friction enhancing means, which enable the front and back parts of the helmet to be reliably locked together in selected positions relative to one another, by pressing the tongues and sections together.

6. A helmet according to claim 1, provided with a replaceable comfort lining in the form of soft foam-plastics pads, which are arranged to conform to the outline of the head of the wearer, to finely adjust the fit of said helmet.

7. A helmet according to claim 1, comprising an impact-receiving shell in the form of a laminate structure comprising a thin, outer plastics layer having bonded to the inner surface thereof a layer of a reinforcing and impact-absorbing plastics material, suitably polyurethane.

8. A helmet according to claim 7, wherein the hinge means between the front and back parts of the helmet is formed in the outer plastics layer.

* * * * *